US005595044A

United States Patent [19]

Kataigi

[11] Patent Number: 5,595,044

[45] Date of Patent: Jan. 21, 1997

[54] METHOD AND DEVICE FOR DETECTING SHORTAGE/EXCESS OF ARTICLE ENCLOSED IN AUTOMATIC MAIL ENCLOSING AND SEALING MACHINE

[75] Inventor: Tutomu Kataigi, Tokyo, Japan

[73] Assignee: Juki Corporation, Tokyo, Japan

[21] Appl. No.: 380,356

[22] Filed: Jan. 30, 1995

[30] Foreign Application Priority Data

Feb. 1, 1994 [JP] Japan ..... 6-010681

[51] Int. Cl.[6] ..... B65B 57/16; B65B 57/18

[52] U.S. Cl. ..... 53/396; 53/56; 53/502; 53/504; 53/508; 73/52

[58] Field of Search ..... 53/396, 473, 502, 53/504, 75, 284.3, 53, 501, 474, 508, 56; 73/52, 149

[56] References Cited

U.S. PATENT DOCUMENTS

| | | | |
|---|---|---|---|
| 3,359,702 | 12/1967 | Beert et al. | 53/53 |
| 3,606,014 | 9/1971 | Linn | 53/53 X |
| 3,956,869 | 5/1976 | Slathar et al. | 53/53 |
| 4,527,378 | 7/1985 | Russell | 53/502 X |
| 4,571,925 | 2/1986 | Adams | 53/502 |
| 4,916,883 | 4/1990 | Focke | 53/53 |
| 5,027,577 | 7/1991 | Creswick | 53/53 |
| 5,321,624 | 6/1994 | Helffrich et al. | 53/284.3 X |
| 5,445,367 | 8/1995 | Long | 53/284.3 X |

FOREIGN PATENT DOCUMENTS

| | | |
|---|---|---|
| 84303883 | 6/1984 | European Pat. Off. . |
| 923039305 | 10/1992 | European Pat. Off. . |
| 2513607 | 9/1982 | France . |
| 920311316 | 10/1992 | Japan . |
| WO84/04280 | 4/1984 | WIPO . |

*Primary Examiner*—Horace M. Culver
*Attorney, Agent, or Firm*— McCormick, Paulding & Huber

[57] ABSTRACT

A method and device for detecting a shortage or excess of an article enclosed in respective envelopes in an automatic mail enclosing and sealing machine. The method comprises the steps of receiving information relative to the number of sheets enclosed in respective envelopes, detecting a variable corresponding to the number of sheets enclosed, discriminating whether the detected variable is within or out of the allowable range corresponding to the sheet number information, and deciding whether a shortage or excess of article is enclosed.

4 Claims, 8 Drawing Sheets

METHOD AND DEVICE FOR DETECTING SHORTAGE/EXCESS OF ARTICLE ENCLOSED IN AUTOMATIC MAIL ENCLOSING AND SEALING MACHINE

TECHNICAL FIELD

This invention relates to a method and device for detecting a shortage or excess of an article enclosed in an automatic mail enclosing and sealing machine and, particularly, to a method and device being adapted to accommodate a change in the number of enclosures enclosed in respective envelopes.

BACKGROUND ART

Recently, a large amount of sealed documents such as direct mail, debit notes and the like are conveyed or mailed from various enterprises to customers by mail and the like, and various automatic mail enclosing and sealing machines have thus been utilized. In such machines, the content of each envelope has been checked automatically.

In a typical prior art mail enclosing and sealing machine, the content of the enclosures being enclosed is checked by measuring the thickness and/or the weight of the enclosure, comparing the measured thickness and/or the weight with a predetermined value.

However, such a machine cannot be utilized when the number and/or the size of the enclosures being enclosed in respective envelopes is not fixed.

Further, prior art thickness and/or weight detecting devices are not satisfactory in terms of reliability and applicability.

SUMMARY OF THE INVENTION

An object of the invention is to overcome the above described discrepancy in the prior art device.

An object of the invention is to provide a reliable method and device for detecting a shortage or excess of an article enclosed in respective envelopes in an automatic mail enclosing and sealing machine.

Another object of the invention is to provide a method and device for detecting a shortage or excess of an article being enclosed in respective envelopes in an automatic mail enclosing and sealing machine and, particularly, in a machine adapted to accommodate a change in the number of enclosures enclosed in respective envelopes.

According to the invention, there is provided a method for detecting a shortage or excess of an article enclosed in respective envelopes in an automatic mail enclosing and sealing machine, comprising the steps of receiving information relative to the number of sheet enclosed in respective envelopes, detecting a variable corresponding to the number of sheets enclosed, discriminating whether the detected variable is within the allowance range corresponding to the sheet number information, and detecting any shortage or excess of the articles enclosed.

In detecting a variable corresponding to the number of sheets enclosed, it is possible to measure the thickness of the sheet enclosed.

According to another feature of the invention, there is provided a device for detecting a shortage or excess of an article enclosed in respective envelopes in an automatic mail enclosing and sealing machine, comprising means for receiving the information relative to the number of sheets enclosed, means for detecting a variable corresponding to the number of sheets enclosed, and means for discriminating whether the detected variable is within an allowable range corresponding to the sheet number information.

The detecting means may be a thickness measuring device for measuring the thickness of the envelope.

In the method for detecting shortage or excess of an article enclosed in respective envelopes in an automatic mail enclosing and sealing machine according to the invention, information regarding the number of sheets enclosed in respective envelopes is received, a variable corresponding to the number of sheets enclosed is detected, and the detected variable is compared with an allowable range corresponding to the sheet number information, thus, even when the number of sheets enclosed in respective envelopes changes with respect to each envelope, information on the number of sheets enclosed in each envelope is transmitted reliably and a shortage or excess of the article being enclosed is determined automatically and reliably.

According to the device detecting shortage or excess of an article being enclosed in respective envelopes in an automatic mail enclosing and sealing machine according to the invention, there are provided sheet number information receiving means for receiving the information relative to the number of the sheet being enclosed in respective envelopes, detecting means for detecting a variable corresponding to the number of sheets enclosed, and discriminating means for discriminating whether the detected variable is within an allowable range corresponding to the sheet number information, thus, the number of sheets enclosed is detected by the sheet number information receiving means, the variable such as the thickness of the sheet being enclosed is detected by the detecting means, and excess or shortage of the enclosure is determined automatically and reliably by the discriminating means by comparing the allowable range with the sheet number information and the variable.

Further, according to the method and device for detecting excess or shortage of the enclosure of the present invention, it is possible to detect automatically and reliably not only the number of sheets enclosed in respective envelopes but also any missing leafs of a booklet when a booklet is selectively enclosed together with an enclosed sheet.

BRIEF DESCRIPTION OF THE DRAWINGS

Further objects and advantages of the invention will become apparent from the following descriptions in conjunction with the attached drawings in which.

DETAILED DESCRIPTION OF THE INVENTION

Figure 8:
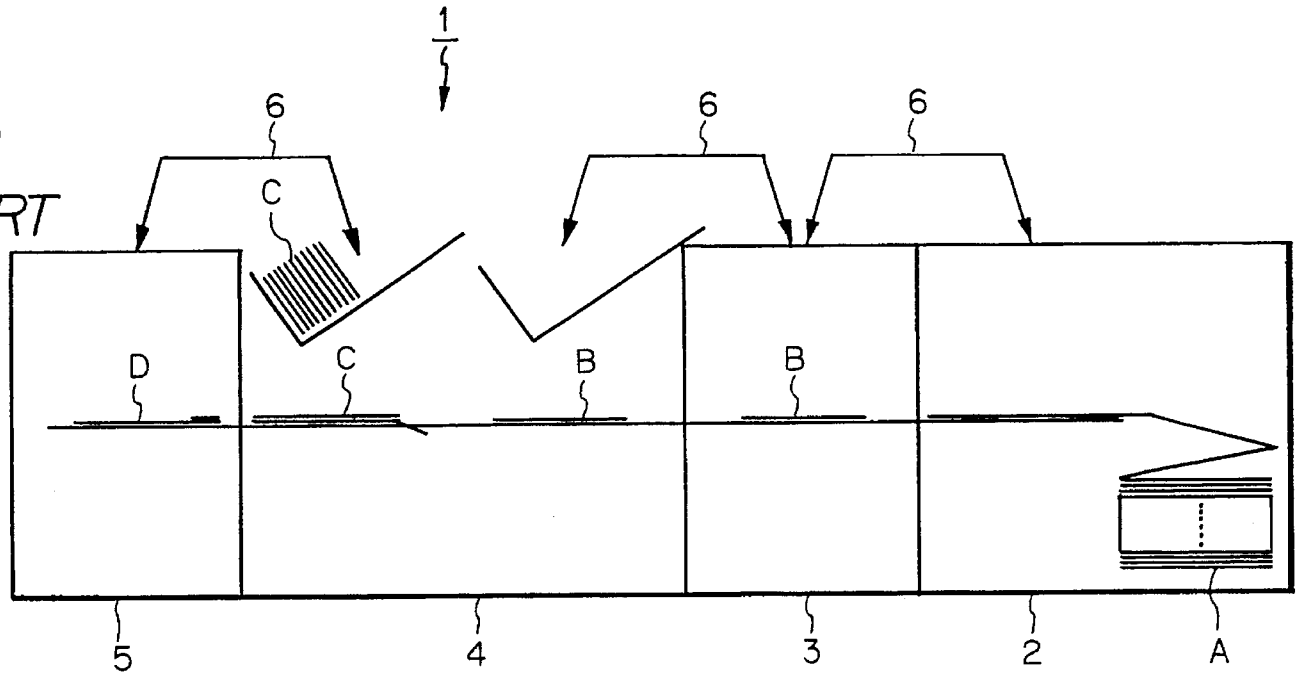
Fig. 8 PRIOR ART
FIG. 8 is a schematic view of a prior art automatic mail enclosing and sealing machine, and showing the content of the process performed in the machine.
Figure 8A:
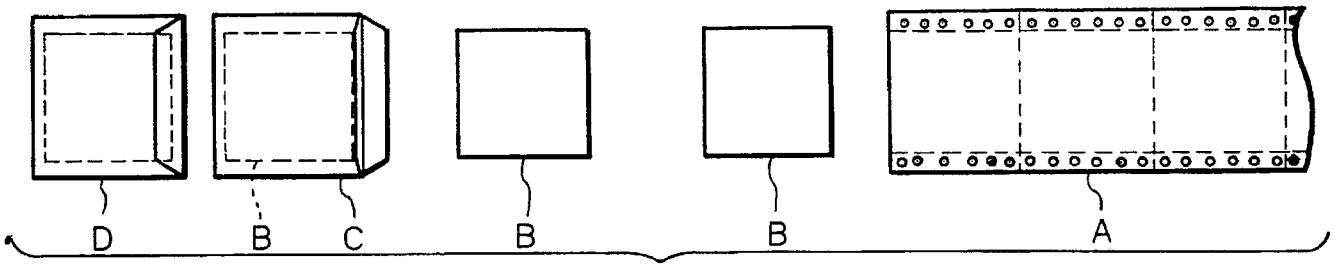
Fig. 8A PRIOR ART
FIG. 8A is a schematic plan view showing the content of the process performed in the prior art automatic mail enclosing and sealing machine of FIG. 8.

FIG. 8 shows a prior art automatic mail enclosing and sealing machine 1 (in the upper or left side portion of the drawing) and the content of the process performed in the machine (in the lower or right side portion of the drawing), in which, a cutter device 2 acts to cut a continuous sheet A into respective sheet B. The sheet B is retained in a storing device 3. Thereafter, the sheet B is enclosed in envelope C by an enclosing and sealing device 4 for making sealed envelopes D. The inspection is performed at an inspection device 5 on the sealed envelopes D. It will be understood that an enclosure (the wording "enclosure" in the specification should be distinguished from the wording "sheet", since the latter is a matter invariably enclosed in each envelope, and the amount of the former enclosed in respective envelopes may be changed). In addition, the device for supplying the enclosure is not shown in the drawing.

In the prior art device, the thickness of the sealed envelope D is measured by such as a thickness sensor, and the acceptance or rejection is determined by comparing the measured value with a proper value being stored in a memory in the inspection device 5 and deciding whether the error therebetween is within or out of the allowable error range. The proper value is obtained by measuring beforehand the thickness of a sealed envelope receiving a predetermined number of sheet B and an enclosure.

The devices 2, 3, 4 and 5 are respectively connected with each other through dual direction communicating devices 6 so that, for example, OMR (Optical Mark Reader) Marks printed beforehand on the continuous sheet A are read by an OMR Mark reading device (not shown in the drawing) provided on the cutter device 2, and the information is transmitted sequentially to devices 3, 4 and 5 synchronously with the progress of the enclosing and sealing process.

The inspection device 5 simply measures the thickness of sealed envelope D and determines acceptance or rejection by comparing it with a set value, thus, when the number of sheets B enclosed in envelope C changes the device 5 does not function properly.

Some preferred embodiments of the present invention will now be explained.

Firstly, an example of an automatic mail enclosing and sealing machine having an inspection device according to the present invention will be explained.

Figures 1, 1A:
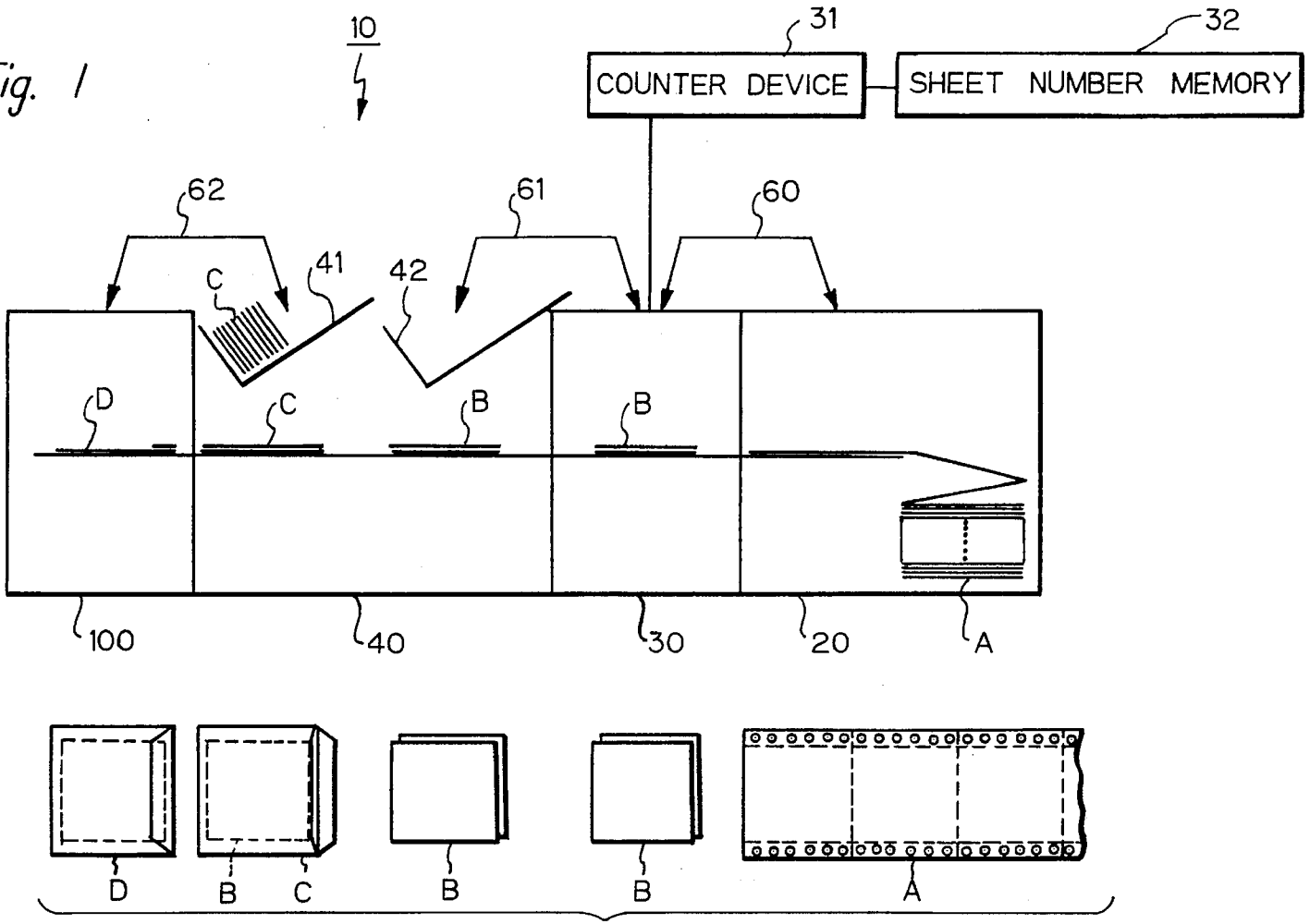
FIG. 1 is a schematic view of an automatic mail enclosing and sealing machine according to a preferred embodiment of the present invention, and showing content of the process performed in the machine.
FIG. 1A is a schematic plan view showing content of the process performed in the machine of FIG. 1.

As shown in FIG. 1, the automatic mail enclosing and sealing machine 10 comprises a cutter device 20 for cutting sheet B from a continuous sheet A, a storing device 30 for retaining temporally the sheet B supplied from the cutter device 20, an enclosing and sealing device 40 for enclosing respective sheet B into respective envelopes C and sealing the envelopes, an inspection device 100 according to the invention for inspecting sealed envelopes D, and other devices. The sheet B, the envelopes C and the like are sequentially conveyed by a transporting mechanism not shown in the drawing through respective devices 20, 30, 40 and 100 sequentially. The cutter device 20 and the storing device 30, the storing device 30 and the enclosing and sealing device 40, and the enclosing and sealing device 40 and the inspection device 100 are respectively connected to each other by dual direction communicating devices 61, 62 and 63 which act to communicate information such as the number of sheets of respective sheet B, the OMR information and the like.

The cutter device 20 has a cutter (cutting blade) for cutting transversely the continuous sheet A and also opposite side (longitudinal) edges to form respective sheet B. Further, the cutter device 20 includes an OMR mark reading device for reading OMR marks M1, M2, M3, . . . (FIG. 2) on the continuous sheet A. Respective sheet B cut by the cutter device 20 and the information read by the reading device are supplied to the storing device 30 through the communicating device 60.

Figure 2:
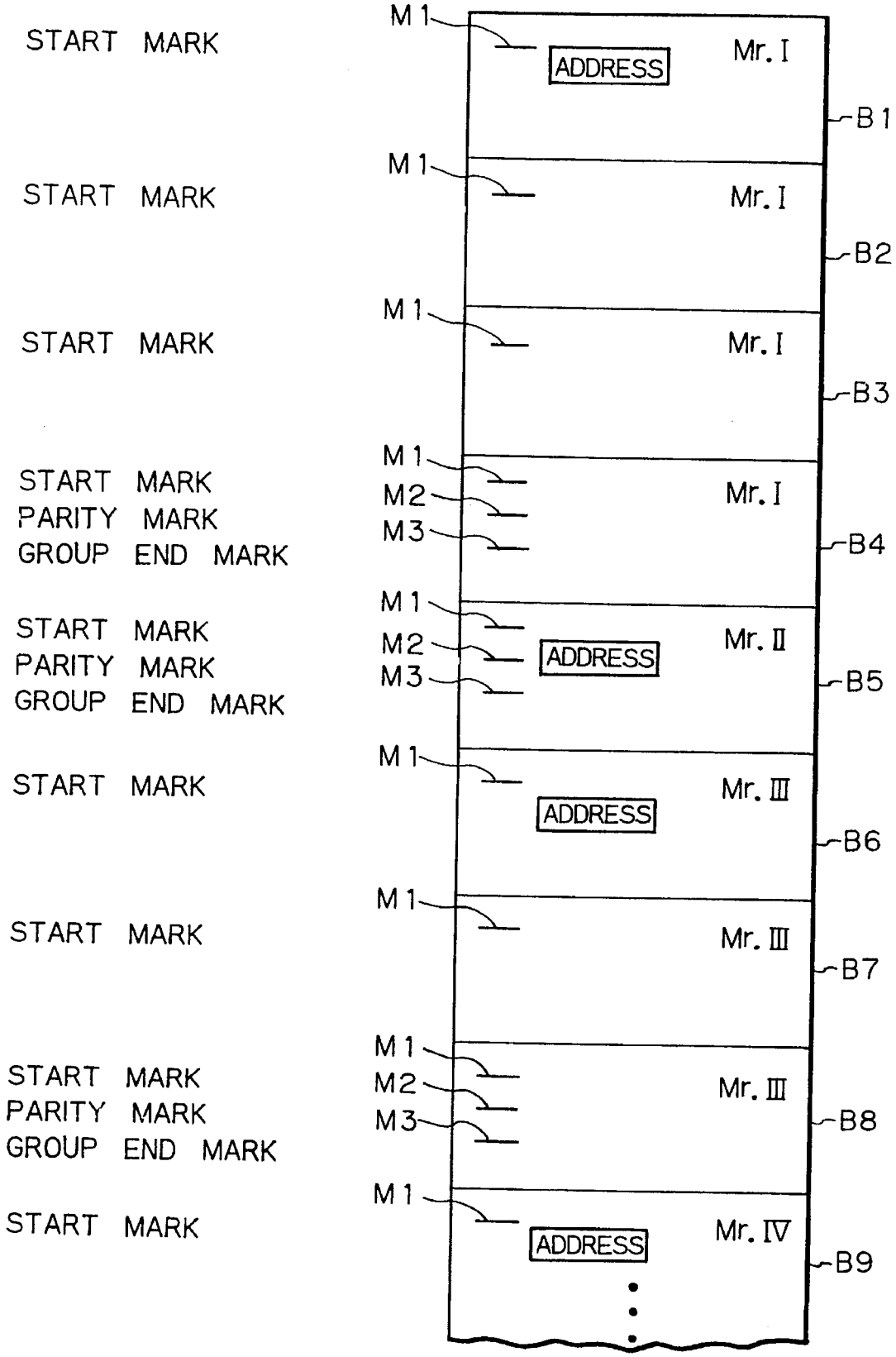
FIG. 2 is a schematic plan view of the enclosure being supplied as a continuous sheet and being cut into respective sheet so as to be enclosed in respective envelopes.

FIG. 2 shows one example of the continuous sheet A having thereon OMR marks M1, M2, M3, . . . . In the embodiment shown in FIG. 2, the OMR marks M1 are start marks defining cutting lines to constitute respective sheet, OMR marks M2 are parity marks which indicate to perform parity checking operations, and OMR marks M3 are group end marks to indicate the last page of a group of sheet enclosed in one envelope. In the embodiment shown in FIG. 2, four sheet B1, B2, B3 and B4 are directed to Address Mr. I, a single sheet B5 is directed to Address Mr. II, three sheet B6, B7 and B8 are directed to Address Mr. III, and sheet including the sheet B9 are directed to Address Mr. IV. It will be understood that the group end marks M3 are attached to the sheet B4 and the sheet B8.

The storing device 30 stores sheet B delivered from the cutter device 20 and, also, detects and stores the OMR information on respective sheet in an OMR information memory device (such as RAM) not shown in the drawing. Further, the storing device 30 is provided with a counter device 31 for counting the number of sheet stored in the device 30, and a memory 32 such as RAM for memorizing the number of sheet counted by the counter device 30.

The operation of the storing device 30 will now be explained. When a sheet B1 addressed to Mr. I is delivered from the cutter device 20 to the storing device 30, the number in the counter device 31 increases by 1 and is stored in the memory 32. Since the sheet B1 does not have OMR mark M3 notifying the group end, the storing device 30 retains the sheet B1 and requests the cutter device 20 through the communicating device 60 to deliver the next sheet B2. When the next sheet B2 is sent to the storing device 30 from the cutter device 20, the number in the counter device 31 is increased by 1 and the number is stored in the memory 32.

The sheet B2 also has no OMR mark M3, thus, the storing device 30 retains the sheet B1 and B2 and requests the cutter device 20 through the communicating device 60 to deliver the next sheet B3. When the next sheet B3 is sent to the storing device 30 from the cutter device 20, the number in the counter device 31 is increased by 1 again and the number is stored in the memory 32. The sheet B3 also has no OMR mark M3, thus, the storing device 30 retains the sheet B1, B2 and B3 and requests the cutter device 20 through the communicating device 60 to deliver the next sheet B4. When the next sheet B4 is sent to the storing device 30 from the cutter device 20, the number in the counter device 31 is increased by 1 again and the number is stored in the memory 32.

The storing device 30 detects the OMR mark M3 on the sheet B4, and delivers the stored sheet B1, B2, B3 and B4 to the enclosing and sealing device 40 and, also, delivers the OMR information stored in OMR information memory device (described hereinafter) and the sheet number information stored in the memory 32 to the enclosing and sealing device 40 through the communicating device 61. Thereafter, the counter device 31 is reset, and the content of the sheet number memory 32 and the content of OMR information memory are cleared, and the sheet B5 addressed to Mr. II is delivered to the storing device 30.

The group end mark M3 may be substituted by a group start mark, in such case, when the storing device 30 receives the group start mark of the next group, the device 30 acts to deliver the group of sheet B retained therein to the enclosing and sealing device 40 before receiving the new sheet B having the group start mark thereon.

The enclosing and sealing device 40 receives a sheet or a group of sheet B delivered from the storing device 30, and encloses the sheet B (together with enclosures such as a pamphlet, a booklet and the like, when such enclosures are requested to be enclosed) (in the embodiment of FIG. 1, such enclosures are not shown) in an envelope C, seals the envelope C, and delivers the sealed envelope D to an inspection device 100. Further, the enclosing and sealing device 40 temporarily retains the OMR information and the sheet number information delivered from the communicating device 61 in a memory provided in the enclosing and sealing device 40 (not shown in the drawing), and delivers to the inspection device 100 when the sealed envelope D is delivered to the inspection device 100. In FIG. 1, shown at numeral 41 is a hopper supplying envelopes and, at 42 is a hopper supplying the enclosures.

The inspection device 100 receives sealed envelopes D delivered from the enclosing and sealing device 40 and, detects a variable such as the weight, thickness or the like which varies in accordance with the number of the sheet B and with the enclosures enclosed in the envelope. The device 100 receives the information from the enclosing and sealing device 40 through the communicating device 62 and decides whether the detected variable is within or out of the allowable range corresponding the information received from the enclosing and sealing device 40. When the result of the test is acceptable, the inspection device 100 delivers the sealed envelope D out of the inspection device 100, and receives another or new sealed envelope D from the enclosing and sealing device 40. When the result of the inspection is unacceptable, the inspection device 100 notifies the unacceptable condition by such as an error condition indication, an alarm or the like, operation of the whole apparatus 10 is suspended.

One example of the inspection device 100 according to the present invention will now be explained with reference to FIGS. 3 and 4.

Figure 3:
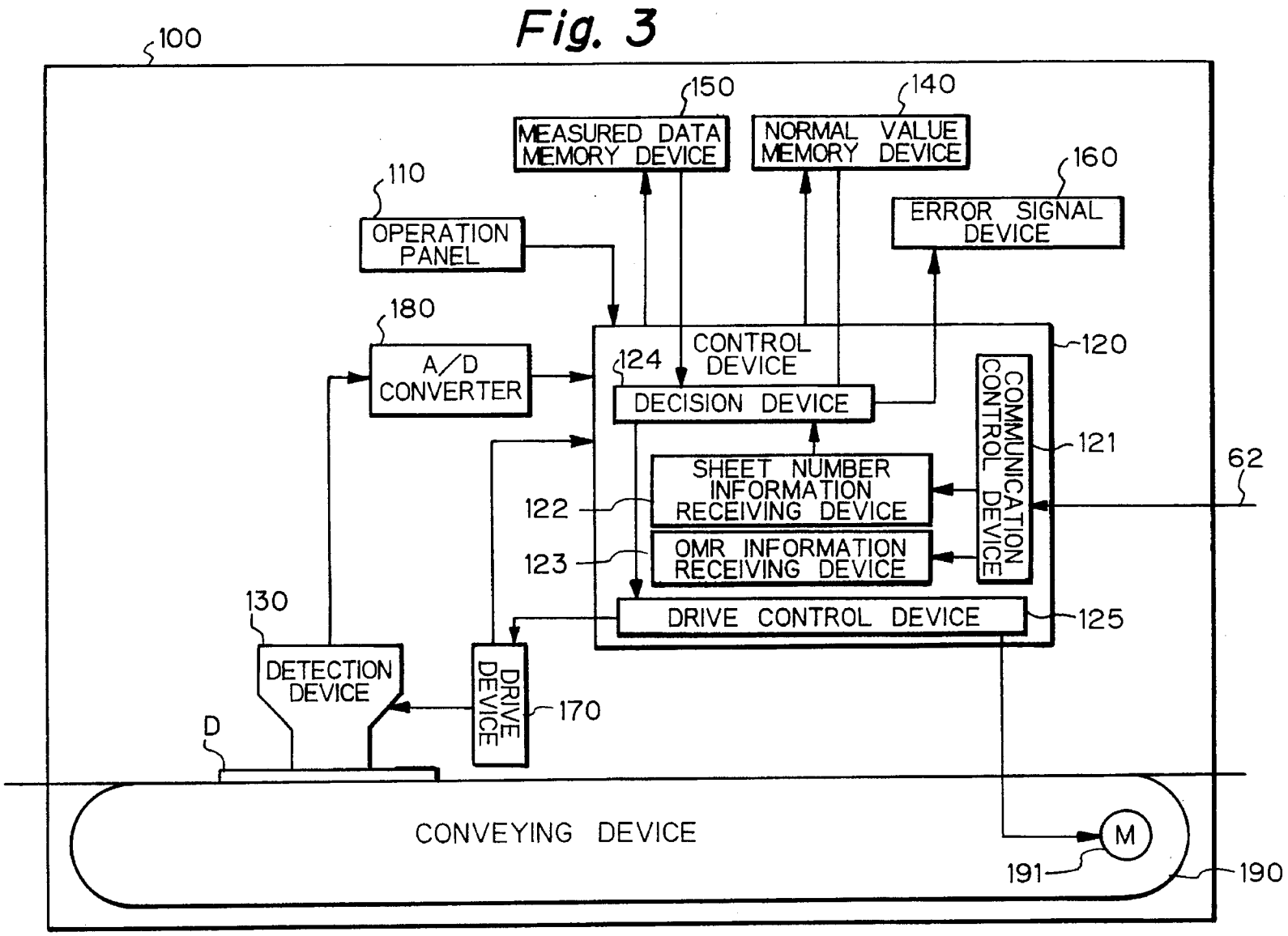
FIG. 3 is a schematic diagram of a detection device of the automatic mail enclosing and sealing machine according to a preferred embodiment of the invention.
Figure 4:
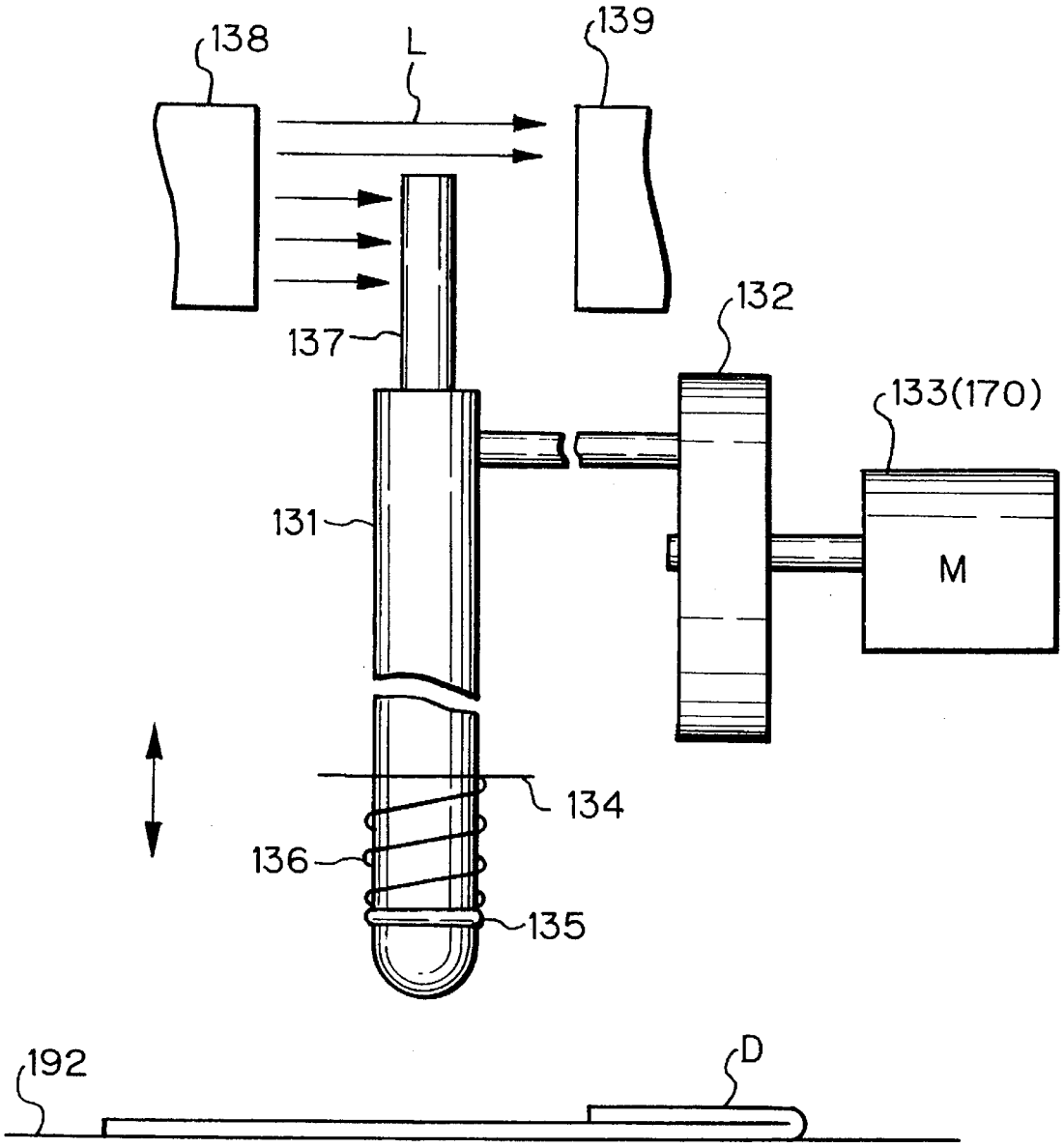
FIG. 4 is a schematic view of the construction of the detection device of FIG. 3.

As shown in FIG. 3, the inspection device 100 comprises an operation panel 110 for effecting various setting and various order; a control device 120 for controlling the whole inspection device 100, for controlling the communication of the communicating device 62, for deciding the acceptance or rejection and the like; a detection device 130 for detecting the variable such as the thickness of the enclosure D; a normal value memory device 140 for memorizing, at the initial setting condition, the data of the normal value of the thickness and the like of the sealed envelope when the content of the enclosure is normal; a measured data memory device 150 for memorizing variables such as thickness of the envelope and the like in effecting the inspection; an error signal device 160 for generating an error signal such as an error indication, an alarm signal and the like when the error condition is found; a drive device 170 for driving the detection device 130; an A/D converter 180 for converting the analog detection signal outputted from the detection device 130 into a digital signal; and a conveying device 190 for conveying the enclosure D to detection position (measuring position).

The operation panel 110 is connected to the control device 120 and has an inspection start button, various setting buttons and the like. Further, there are provided on the operation panel 110 various indication devices such as CRT, LCD and the like (not shown in the drawing) for indicating the operating condition of the inspection device 100.

The control device 120 is constituted of a control circuit including a micro-computer, and is provided with a communication control device 121 for controlling the communicating device 62, a sheet number information receiving device 122 and an OMR information receiving device 123 receiving respectively the sheet number information and the OMR information sent from the enclosing and sealing device 40, a decision device 124 for deciding acceptance or rejection of the envelope D, and a drive control device 125 for controlling the drive device 170 and controlling a drive motor 191 of the conveying device 190.

The communication control device 121 acts to control the communicating device 62 and, also, to receive from the communicating device 62 the sheet number information and the OMR information and to output them respectively to the sheet number information receiving device 122 and to the OMR information receiving device 123. The sheet number information receiving device 122 and the OMR information receiving device 123 act to memorize respective information received from the communication control device 121 in memory device such as RAM and the like not shown in the drawing. Further, the sheet number information receiving device 122 reads the sheet number information of the sealed envelope D being inspected from the memory and outputs the information to the decision device 124.

In deciding acceptance or rejection of the sealed envelope D being tested, the decision device 124 receives the sheet number information from the sheet number information receiving device 122 and receives the normal value from the normal value memory device 140 to decide the allowable range corresponding to the number of sheets. Further, the decision device 124 receives the variable (measured value) from the measured data memory device 150 which has been measured by the detection device 130 and stored temporally in the device 150, and compares the measured value with the allowable range to decide acceptance or rejection. When the result of the test is acceptable, the decision device 124 sends an acceptance signal to the drive control device 125 and the device 125 outputs drive signal to the drive motor 191 to actuate the conveying device 190. When the result of the test is unacceptable, the error signal is outputted from the decision device 124 to the error signal device 160. The device 160 indicates the error condition.

The drive control device 125 controls the drive motor 191 to move the sealed envelope D being transported from the enclosing and sealing device 40 to the measuring position just below the detection device 130 and stops it at the position. Also, the device 125 controls the drive device 170 such that when the sealed envelope D is stopped at the measuring position, the detection device 130 acts to start the detection. Particularly, as shown in FIG. 4, the detection device 130 includes a detecting rod 131 vertically movably supported by a drive motor 133 which is one constituting element of the drive device 170. The drive control device 125 controls the drive of the drive device 170 such that the detecting rod 131 moves downward against and presses suitably the sealed envelope D. Further, the detecting rod 131 is supported by drive motors and the like (not shown in the drawing and being also constituting elements of the drive device 170) to move in a plane parallel to the surface of a conveying table 192 of the conveying device 190. Such movement of the detecting rod 131 is also controlled by the drive control device 125.

The detection device 130 shown in the embodiment is a thickness measuring device for measuring the thickness of the sealed envelope D. The device 130 consists mainly of the detecting rod 131, the drive motor 133, a crank mechanism 132 connecting the detecting rod 131 with the drive motor 133, a spring 136 provided between a guide 134 and a flange 135, a light intercept member 137 integral to the detecting rod 131 to move vertically, a light sensor consisting of a light emitting member 138 emitting such as laser light L and the like and a light receiving portion 139 for receiving the laser light L and the like. The spring 136 permits upward movement of the detecting rod 131 by the amount corresponding to the thickness of the sealed envelope D at the lower dead point of the downward movement of the detecting rod 131 which is caused by the drive motor 133, and the light intercept member 137 intercepts a portion of the laser light L and the like of the light sensor, thereby, the amount of the displacement of the upper end of light intercept member 137 is detected and the thickness of the sealed envelope D is measured.

The light emitting member 138 emits continuously the laser light L and, the light receiving portion 139 outputs to the control device 120, through the A/D converter 180, a detecting signal corresponding to the amount of displacement of the light intercept member 137 or to the amount of the displacement of the detecting rod 131. The control device 120 receives from the drive device 170 a valid reading signal notifying that the detecting rod 131 is at the lower dead center, and reads at the timing synchronous to the valid reading signal the signal detected by the detection device 130 as a valid signal. When the signal detected by the control device 120 is the normal value as determined at the initial setting before starting the inspection procedure, the data such as the allowable range of the normal value and the like is memorized in the normal value memory device 140 as the normal value data, and when the signal detected by the control device 120 is the measured value in performing the measurement, the data is memorized by the measured data memory device 150 as the measured data.

The normal value memory device 140 is constituted of such as RAM and the like connected to the control device 120, and stores the data of the normal value being sent from the control device 120. The measured data memory device 150 is constituted of RAM and the like which is connected to the control device 120, and the data of the measured data sent from the control device 120 is stored therein.

The error signal device 160 is connected to the decision device 124, and when the error signal is sent from the decision device 124 the error condition is indicated. An indication device and the like mounted on the operation panel 110 is utilized to indicate the error condition.

Figure 5:
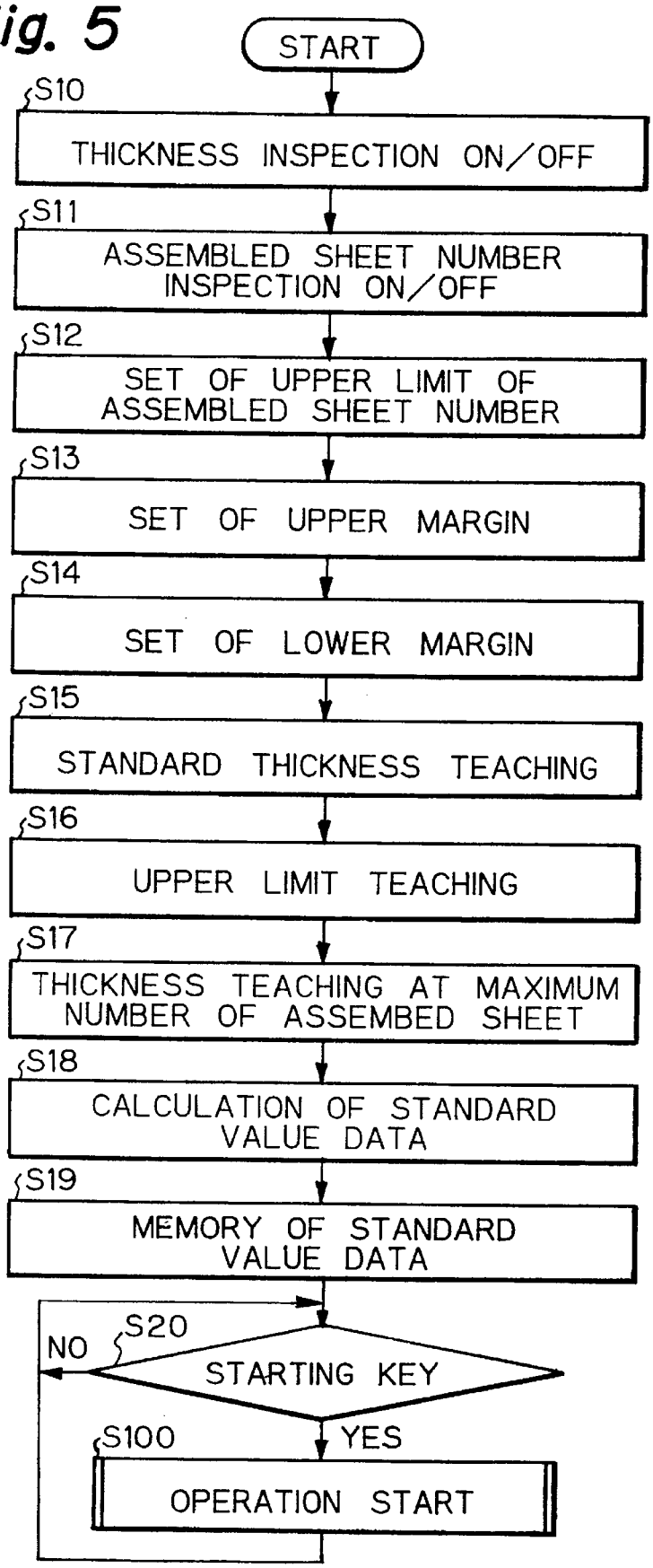
FIG. 5 is a flow chart showing the initial setting in the inspection method according to the invention.
Figure 6:
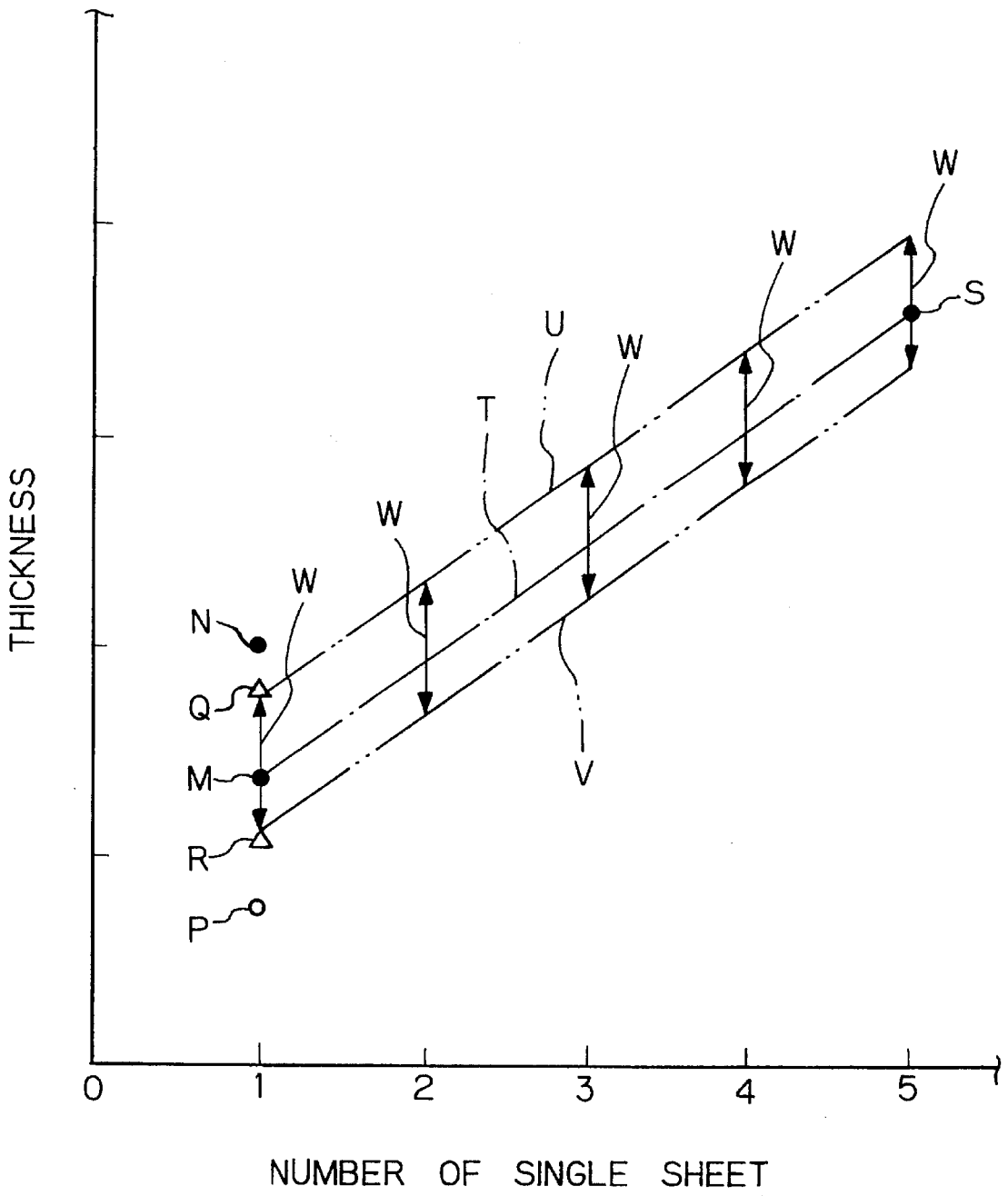
FIG. 6 is a diagram showing the method for determining the allowable range during the initial setting process of FIG. 5.

One example of the initial setting procedure performed in the inspection device 100 will be explained in referring the FIGS. 5 and 6.

In starting the initial setting, the operation panel 10 is operated to set up ON/OFF of the thickness inspection (Step S10). This step is to perform the thickness inspection by the inspection device 100, and to determine whether or not to stop the operation of the automatic mail enclosing and sealing machine 10 when the measured data is not normal. In the example, the process is set to ON and the thickness inspection process is performed.

In the Step S11, the operation panel 110 is manipulated to perform ON/OFF of the assembling operation. This step is to decide whether the mail enclosing and sealing operation performed in the automatic mail enclosing and sealing machine 10 is based on the assembling function utilizing the OMR marks provided on the continuous sheet A. In the example, the assembling function is utilized, thus, the step is set to ON.

In the Step S12 the upper limit of the number of sheet enclosed in one envelope is set, in the Step S13 the upper limit of the allowance (upper margin) of the measured value of the thickness of the sealed envelope when the measuring process is set, and in the Step S14 the lower limit of the allowance (lower margin) of the measured value is set. These setting is performed by manipulating the operation panel 110, and the data of the maximum number of the sheet assembled is memorized in RAM and the like, and the set data of the upper and lower margin are retained in the working area and the like of the memory of the control device 120. Preferably, the upper and the lower margins are denoted by percentage.

In the Step S15, a standard thickness teaching is performed. For example, a sealed envelope D having therein a single sheet B is set on the detection device 130 and a standard value of the envelope having a single sheet (single sheet standard) (such as shown in mark M in FIG. 6) is obtained. In such case, even when some other enclosures are enclosed together with the sheet B the effect of such enclosures may be neglected when the enclosures are constant with respect to all envelopes.

In the Step S16, an upper limit teaching is performed. A single sheet B is put on the envelope D which has been utilized in the Step S15 and the thickness is measured by the detection device 130 to obtain a value N (FIG. 6) (upper limit value) notifying that the upper allowable limit is exceeded. The thickness value lower than the lower allowable limit (when the number of the enclosed sheet B is smaller by one sheet) as shown in P0 in FIG. 6 (lower limit value) is obtained from the equation (1) shown below by the calculation performed in the control device 120. These data are stored in such as the working area of the memory in the control device 120.

$$\text{(lower limit value)}=\text{(single sheet standard)}-[\text{(upper limit value)}-\text{(single sheet standard)}] \quad (1)$$

In the Step S17, the thickness teaching at the maximum assembled condition is performed. In FIG. 6, the maximum number of the sheet B enclosed in the envelope is 5 (five) and (maximum sheet standard) is shown as S in FIG. 6.

Based on upper margin and lower margin set in the steps 13 and 14 and on the upper limit value N and the lower limit value P, the control device 120 performs calculation of equations (2) and (3) to obtain the upper allowable range (between QΔ and M in FIG. 6) and the lower allowable range (between M and RΔ in FIG. 6) with respect to the one sheet standard M are calculated as the data of the standard value (Step S18). In the Step S19, the data of the calculated upper range and lower range, together with the single sheet standard M and the maximum sheet standard S are stored in a standard value memory device 140.

(upper range)=[(upper limit value)−(single sheet standard)]×(upper margin) (2)

(lower range)=[(upper limit value)−(single sheet standard)]×(lower margin) (3)

In the embodiment, the allowable range W (FIG. 6) corresponding to respective number of sheet B in performing the detection is determined by the calculation performed in the decision device 124 from the maximum sheet standard S, the single sheet standard M, and the upper range Q and the lower range R of the single sheet standard. Namely, as shown in FIG. 6, the maximum sheet standard S and the single sheet standard M are connected by a straight line (shown as a chain dot line T), and two straight lines (double dot chain lines U and V) being parallel to the straight line T and passing respectively the upper range Q and the lower range R are obtained. Then, the allowable range W is defined between straight lines U and V.

The initial setting for performing the mail enclosing and sealing operation including assembling of the sheet in the inspection device 100 has now been completed. The inspection device 100 is at inspection waiting condition (Step S20), until a starting key (not shown in the drawing) in the operating panel 100 is actuated. When the starting key is actuated (Step S100) the operation is started.

Figure 7:
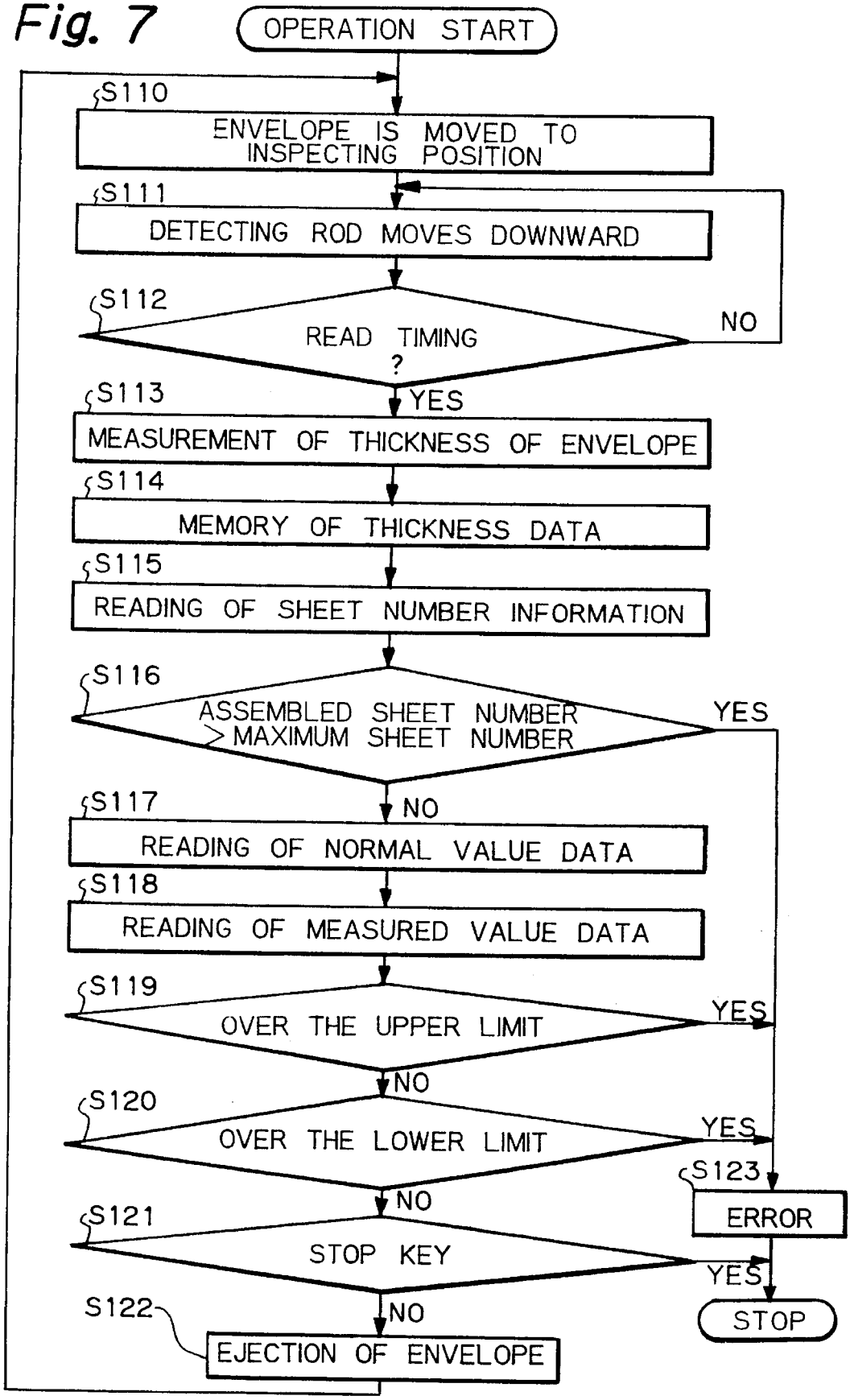
FIG. 7 is a flow chart showing an example of inspection procedure according to the invention.

FIG. 7 shows one example of inspection process performed in the inspection device 100.

When the starting key in the operating panel 100 is actuated, the sealed envelope D conveyed from the enclosing and sealing device 40 is moved by the conveying device 190 to the measuring position below the detection device 130 and is stopped (Step S110). Thereafter, the detecting rod 131 is moved downward by the drive device 170 to press the envelope D (Step S111).

When the detecting rod 131 is at the lower dead center, the read effective signal is inputted to the control device 120 from the driving device 170, and the control device 120 decides that it is a read timing (Step S112), measured value of the thickness inputted from the detection device 130 to the control device 120 at that instant is decided effective, and the measurement of the thickness is completed (Step S113). The measured value is memorized in the measured data memory device 150 as the data of the thickness of the sealed envelope D being tested (Step S114).

Then, the sheet number information (assembling information) which has been sent from the storing device 30 through the communicating devices 61 and 62 and through the enclosing and sealing device 49, and has been stored in the memory is read (Step S115), and when the assembling information is larger than the maximum assembling number of the sheet as determined in Step S12 of the initial setting process (Step S116), the process goes to the error condition (Step S123) and the detection process stops. In Step S116, when the assembling information is not larger than the maximum assembling number, the detection process is continued. In Step S117, the data of the normal value is read from the normal value memory device 140, and in Step S118, the data of the measured value is read from the measured data memory device 150.

In the decision device 124, based on the maximum sheet standard S, the single sheet standard M, the upper limit of the range (Q−M), and on the maximum number of assembled sheet which have been read from the normal value memory device 140, the value of the right side of the equation (4) shown below, or the upper limit of allowable range at specified assembled sheet in the sealed envelope D is obtained from the calculation. Further, in Step S119, the decision device 124 compares the upper limit with the measured value. When the measured value is larger than the upper limit value, or when the equation (4) is satisfied, it is decided to exceed the upper limit and, the step proceeds to the error condition (Step S123) and the inspection process stops.

(measured value)>(maximum sheet standard−single sheet standard)×(assembled sheet number−1) /(maximum assembled sheet number−1)+(single sheet standard)+(upper limit) (4)

When the upper limit is not exceeded in Step S119, the process proceeds to Step S120, in which, based on the maximum sheet standard S, the single sheet standard M, the range of the lower limit (M−R), the maximum assembled sheet number, and on the assembled sheet number in the envelope D, the right side of the equation (5) shown below or the lower limit of allowable range in the specified number of assembled sheet is obtained by calculation. The decision device 124 compares the measured value with the lower limit and, when the measured value is smaller than the lower limit, or when the equation (5) is satisfied, the step proceeds to the error condition (Step S123) and the inspection process stops.

(measured value)<(maximum sheet standard−single sheet standard)×(assembled sheet number−1)/ (maximum assembled sheet number−1)+(single sheet standard)−(lower limit) (5)

When the measured value is not smaller than the lower limit in Step S120, the process proceeds to Step S121. When the stop key (not shown) on the operating panel is actuated, the operation stops irrespective to the error condition. When the stop key is not actuated, the process proceeds to Step S121, in which, the conveying device 190 ejects the inspected sealed envelope D, and the next envelope is conveyed from the enclosing and sealing device 40 to the inspection device 100, and the process starting from Step S110 is performed on the next envelope D.

According the embodiment, the inspection device 100 having the sheet number information receiving device 122 receiving the information of the number of the sheet enclosed in specified envelope D, the detection device 130 detecting the thickness of the envelope D, and decision device 124 deciding whether the measured value of the thickness of the envelope D obtained by the detection device 130 is within or not the allowable range corresponding the sheet number information received on the sheet number information receiving device 122 is utilized, to receive the information of the number of the sheet B enclosed in the specified envelope D, to measure the thickness of the envelope D, and to compare the measured data with the allowable range corresponding to the sheet number information, thus, even when the number of the sheet B enclosed in respective envelopes is not constant and varies on respective envelope, the decision device decides acceptance or rejection based on the allowable range as determined by respective sheet number information, thus, the inspection whether the sheet B are properly enclosed in the assembled and sealed envelope D or not can be performed automatically.

Further, even when enclosures such as a pamphlet and the like are enclosed together with the sheet B with the number of the sheet changing by the assembling operation, it is possible not only to check automatically an excess or shortage of the sheet B enclosed, but also to check automatically the excess or shortage of the enclosures and to check such as missing or excess leafs in the pamphlet when the enclosure is a pamphlet.

In the embodiment, the detection device 130 is a thickness measuring device measuring the thickness of the sealed envelope D, however, the detection device is not limited thereto and, may be any other devices detecting the variable such as the weight and the like which changes in accordance with the number of the sheet B enclosed in the sealed envelope D. Further, the sensor is not limited to the optical sensor utilizing the laser light.

In the embodiment, it is performed during the initial setting procedure, the standard thickness teaching deciding the single sheet standard (Step S15) and the maximum thickness teaching deciding the maximum sheet standard (Step S17) are performed, and the data therebetween is obtained by interpolation method, however, the process is not limited thereto, the process may be performed with respect to three or more cases.

Further, in the embodiment, the interpolation is performed by straight lines based on the measured data, but the process is not limited thereto and, the measured data may be corrected by such as multiplying a coefficient correcting the linearity of the light sensor, or the allowable range in the assembled sheet may be corrected.

Further, in the embodiment, the teaching process (Steps S15 and S17) are performed with respect to the single sheet condition and the maximum sheet condition, but the process are not limited thereto and may be performed at least two different sheet number conditions.

In the embodiment, the enclosed and sealed envelopes are inspected, however, the inspection may be performed prior to the enclosing operation.

The normal value and the allowable range may be stored beforehand in such as ROM and the like, or may be inputted by the operating panel manually.

Further, in the embodiment, the sheet number information is sent through the communicating device 62 to the sheet number information receiving device 122, but the invention is not limited thereto. The information of the number of the sheet enclosed in respective envelopes may be stored in such as RAM and the like so that in detecting respective envelopes the sheet number information of corresponding envelope is supplied to the sheet number information receiving device 122 from the RAM and the like.

Further, the calculations described as above for obtaining the allowable range may be changed as desired.

Further, the initial setting procedure and the inspection performing procedure described as above are only examples, and do not intended to limit the invention. Such procedure may be modified accordingly.

The details of the inspection device 100 may be changed as desired. The inspection device 100 may be provided independently from the automatic mail enclosing and sealing device 10. When the inspection device 100 is provided independently the data of the number of the sheet is preferably supplied through RAM and the like, not from the communicating device 62.

As described heretofore, according to the method for detecting excess/shortage of article enclosed in envelopes of the present invention, the method comprises the steps of receiving the information relative to the number of sheet being enclosed in respective envelopes, detecting the variable such as the thickness of the envelope and corresponding the number of sheet being enclosed, discriminating whether the detected variable is within or out of the allowance range corresponding the sheet number information, and deciding shortage or excess of the article being enclosed, thus, even if the number of the sheet changes with respect to respective envelopes, the information of the sheet number is transmitted and excess or shortage of the enclosure is decided based on the allowable range, thus, it is possible to reliably decide whether suitable number of the sheet is enclosed in the envelope or not. Thus, the applicability of the automatic mail enclosing and sealing machine is improved substantially.

Further, according to the present invention, the device for detecting shortage or excess of an article being enclosed in respective envelopes in an automatic mail enclosing and sealing machine is provided, and the device comprises means for receiving the information relative to the number of the sheet being enclosed, means for detecting the variable corresponding the number of sheet being enclosed, and means for discriminating whether the detected variable is within or out of an allowable range corresponding to the sheet number information, thus, the detection can be performed automatically to reliably decide whether suitable number of the sheet is enclosed in the envelope or not even though the case in which the number of the sheet enclosed in respective envelopes varies. Further, the enclosure enclosed in respective envelopes may include such as a booklet and the like in addition to the sheet. Thus, the applicability of the automatic mail enclosing and sealing machine is improved substantially.

What is claimed is:

1. A method of detecting a shortage or excess of an article including at least one sheet enclosed in respective envelopes in an automatic mail enclosing and sealing machine, said method comprising the steps of;

detecting a unit value of the sheet to be enclosed and setting the allowable range according to the detected value, receiving information regarding the number of sheets to be enclosed in respective envelope, detecting a variable corresponding to the number of sheets being enclosed, by measuring the thickness of respective envelopes, discriminating whether the detected variable is within an allowable range corresponding to the sheet number information, and determining whether a shortage or excess of articles is enclosed.

2. A method of detecting a shortage or excess of an article including at least one sheet enclosed in respective envelopes in an automatic mail enclosing and sealing machine, said method comprising the steps of;

detecting a unit value of the sheet to be enclosed and setting the allowable range according to the detected value, receiving information regarding the number of sheets to be enclosed in a respective envelope, detecting a variable corresponding to the number of sheets being enclosed, by measuring the weight of respective envelopes, discriminating whether the detected variable is within an allowable range corresponding to the sheet number information, and determining whether a shortage or excess of articles is enclosed.

3. A device for detecting a shortage or excess of an article including at least one sheet enclosed in respective envelopes in an automatic mail enclosing and sealing machine, said device comprising;

means for detecting a unit value of the sheet to be enclosed and setting the allowable range according to the detected value, means for receiving information regarding the number of sheets to be enclosed, means for detecting a variable corresponding to the number of sheets enclosed, comprising a device for measuring the thickness of envelope, and means for discriminating whether the detected variable is within an allowable range corresponding to the sheet number information.

4. A device for detecting a shortage or excess of an article including at least one sheet enclosed in respective envelopes in an automatic mail enclosing and sealing machine, said device comprising;

means for detecting a unit value of the sheet to be enclosed and setting the allowable range according to the detected value, means for receiving information regarding the number of sheets to be enclosed, means for detecting a variable corresponding to the number of sheets enclosed, comprising a device for measuring the weight of envelope, and means for discriminating whether the detected variable is within an allowable range corresponding to the sheet number information.

* * * * *